US011635014B2

(12) United States Patent
Kim et al.

(10) Patent No.: US 11,635,014 B2
(45) Date of Patent: Apr. 25, 2023

(54) COOLING MODULE FOR MOTOR VEHICLE

(71) Applicant: Hanon Systems, Daejeon (KR)

(72) Inventors: Young Sam Kim, Daejeon (KR); Dong Mi Jeong, Daejeon (KR)

(73) Assignee: Hanon Systems, Daejeon (KR)

( * ) Notice: Subject to any disclaimer, the term of this patent is extended or adjusted under 35 U.S.C. 154(b) by 88 days.

(21) Appl. No.: 17/215,422

(22) Filed: Mar. 29, 2021

(65) Prior Publication Data

US 2021/0363911 A1 Nov. 25, 2021

(30) Foreign Application Priority Data

May 20, 2020 (KR) ..... 10-2020-0060430
Mar. 4, 2021 (KR) ..... 10-2021-0028842

(51) Int. Cl.
*F01P 3/18* (2006.01)
*F01P 5/02* (2006.01)

(52) U.S. Cl.
CPC ..... *F01P 3/18* (2013.01); *F01P 5/02* (2013.01); *F01P 2003/182* (2013.01); *F01P 2003/185* (2013.01); *F01P 2070/50* (2013.01); *F01P 2070/52* (2013.01)

(58) Field of Classification Search
CPC ..... F01P 3/18; F01P 5/02; F01P 2003/182; F01P 2003/185; F01P 2070/50
See application file for complete search history.

(56) References Cited

U.S. PATENT DOCUMENTS 6,059,019 A * 5/2000 Brost ..... F28D 1/0435 123/41.51
9,719,734 B2 * 8/2017 Takahashi ..... F28F 9/02
10,935,331 B2 * 3/2021 Pereira ..... F28F 9/002

OTHER PUBLICATIONS

Da-Sol Kim, "Genesis launches revamped third-generation G80", The Korea Herald (www.koreaherald.com <http://www.koreaherald.com>); <http://www.koreaherald.com/common/newsprint.php?ud=20200330000628>, Mar. 30, 2020, 13:14, 3 pages.
Jun-Sung Lee, "Hyundai Motor offers free software repairs for New G80 causing controversy over many defects", Korea IT Times, <http://www.koreaittimes.com/news/articleView.html?idxno=98649>, Jun. 30, 2020, 10:46, 2 pages.

* cited by examiner

*Primary Examiner* — Kevin A Lathers
(74) *Attorney, Agent, or Firm* — Norton Rose Fulbright US LLP; James R. Crawford

(57) ABSTRACT

Provided is a cooling module for a motor vehicle, which modulates heat exchangers installed in front of an engine room of a motor vehicle, and more particularly, a cooling module for a motor vehicle, which is more easily assembled and has improved assembly precision by including a plate housing casing a plurality of radiators and preventing a core portion of the radiator from being damaged during assembling the radiators to each other.

16 Claims, 9 Drawing Sheets

COOLING MODULE FOR MOTOR VEHICLE

CROSS-REFERENCE TO RELATED APPLICATIONS

This application claims priority under 35 U.S.C. § 119 to Korean Patent Application No. 10-2020-0060430 filed on May 20, 2020 and Korean Patent Application No. 10-2021-0028842 filed on Mar. 4, 2021, in the Korean Intellectual Property Office, the disclosure of which is incorporated herein by reference in its entirety.

TECHNICAL FIELD

The following disclosure relates to a cooling module for a motor vehicle, which modulates heat exchangers installed in front of an engine compartment of a motor vehicle, and more particularly, to a cooling module for a motor vehicle, which is more easily assembled and has improved assembly precision by including a plate housing encasing a plurality of radiators and preventing a core portion of the radiator from being damaged during assembling the radiators to each other.

BACKGROUND

In recent years, with regard to an assembling process of a motor vehicle, a technology has been proposed in which an assembly including a plurality of assembled components is assembled on an assembly line, i.e. modularization technology, to simplify and automate the process and to improve its productivity.

A typical example may be a front end module, which is modularized by assembling a cooling module, a headlamp and a bumper including a bumper beam to one another.

The front end module may be modularized as follows: the cooling module, which includes a radiator, a condenser and a fan shroud, is mounted on a cooling module mounting portion of a carrier centering on the carrier disposed in a center of the module; the headlamp is mounted on a headlamp mounting portion of the carrier; and the bumper beam is mounted on the front of the carrier.

FIG. 1 is an exploded perspective view of a conventional cooling module M for a motor vehicle. As shown in the drawing, the cooling module M for a motor vehicle may be configured by modularizing: a radiator R through which a coolant flows to cool an engine; a condenser C disposed in front of the radiator R and through which a refrigerant flows to condition indoor air; and a fan shroud F disposed at rear of the radiator R and cooling the radiator R and the condenser C by forced air when the operation of the motor vehicle ceases.

Meanwhile, a plurality of radiators may be disposed in a motor vehicle having an internal combustion engine requiring a large amount of heat dissipation, a hybrid electronic vehicle or an electric vehicle. In particular, hybrid electronic vehicles or electric vehicles may additionally include an electric radiator for cooling electronic equipment, so more assembly steps are needed to precisely assemble the plurality of radiators in their exact positions. In addition, when assembling the plurality of radiators, a header tank of one radiator and a core portion of another radiator may interfere with each other, and the core portion may thus be damaged or broken.

SUMMARY

An exemplary embodiment of the present disclosure is directed to providing a cooling module for a motor vehicle having improved assembly convenience by using a plate assembly that guides assembly of a plurality of radiators and cases the radiators for motor vehicles having including a plurality of radiators, such as hybrid electronic vehicles, electric vehicles or a motor vehicle that has an intercooler.

Another exemplary embodiment of the present disclosure is directed to providing a cooling module for a motor vehicle that includes a core damage prevention structure formed on each of the plurality of radiators, thereby preventing a core portion of another radiator from being damaged by another radiator when the plurality of radiators are coupled to the plate assembly.

In one general aspect, a cooling module 1000 for a motor vehicle, including heat exchangers 200 and 300 and a fan shroud F, includes: a plurality of heat exchangers 200 and 300; a plate assembly 100 including a lower plate 110 to which lower ends of the plurality of heat exchangers 200 and 300 are respectively coupled to case the plurality of heat exchangers 200 and 300; and separation means 211 and 311 preventing a core portion 220 of a first heat exchanger 200 from being damaged when mounting a second heat exchanger 300 on the lower plate 110 after first mounting the first heat exchanger 200 on the lower plate 110, among the plurality of heat exchangers 200 and 300.

In addition, the first heat exchanger 200 may include a first header tank 210 formed on each side thereof in a width direction of a motor vehicle, and the core portion 220 is formed between the pair of first header tanks 210. Separation means 211 and 311 may prevent the core portion 220 and the second header tank 310 which is formed on each side of the second heat exchanger 300 in the width direction of the motor vehicle from being in contact with each other when the second heat exchanger 300 is coupled to the lower plate 110.

In addition, the separation means 211 (which may be a separation rail) and 311 may include a separation protrusion 311 protruding from the second header tank 310 toward the first heat exchanger 200. Separation rail 211 is formed on the first header tank 210 and protrudes toward the second heat exchanger 300 to come in contact with an end of the separation protrusion 311 when the second heat exchanger 300 is coupled to the lower plate 110, and formed in the vertical direction. Separation protrusion 311 may come in contact with the separation rail 211 and slide downward when the second heat exchanger 300 is coupled to the lower plate 110.

In addition, the separation rail 211 may have an end protruding further toward the second heat exchanger 300 than an end of the core portion 220 on a basis of the second heat exchanger 300.

In addition, a point at which the separation rail 211 and the separation protrusion 311 come into contact with each other when the second heat exchanger 300 is coupled to the lower plate 110 may be disposed to be spaced apart from the end of the core portion 220 toward the second heat exchanger 300.

In addition, the lower plate 110 may include: a first slot 111 to which the first heat exchanger 200 slides downward to be coupled, and a second slot 112 to which the second heat exchanger 300 slides downward to be coupled and which is formed in front of or behind the first slot 111 in front and rear directions of the motor vehicle.

In addition, the first slot 111 may include a first seating groove 113 formed on each side of the first slot 111 in the width direction, the first seating groove 113 seating a first fixing protrusion 212 thereon, and the first fixing protrusion 212 protruding outward from a lower end of the first header tank 210 in the width direction, and the second slot 112 may include a second seating groove 114 formed on each side of the second slot 112 in the width direction, the second seating groove 114 seating a second fixing protrusion 312 thereon, and the second fixing protrusion 312 protruding outward from a lower end of the second header tank 310 in the width direction.

In addition, the first heat exchanger 200 may slide vertically to be coupled to the first slot 111, and the second heat exchanger 300 may be slide-coupled to the second slot 112 in a state in which the second heat exchanger 300 is tilted outward from the first heat exchanger 200 to have an upper side further spaced apart from the first heat exchanger 200, and the second heat exchanger 300 completes its coupling with the lower plate 110 by pivoting the upper side of the second heat exchanger 300 toward the first heat exchanger 200 in a state in which the second heat exchanger 300 completes its slide.

In addition, as the second heat exchanger 300 slides downward, the second fixing protrusion 312 may be seated in the second seating groove 114, and the second heat exchanger 300 may then be pivoted using the second fixing protrusion 312 as its rotating shaft to be closely coupled to the first heat exchanger 200.

In addition, a recessed rail groove 215 may be formed on a lower end of the separation rail 211, which comes in contact with the separation protrusion 311, to prevent interferences by the separation protrusion 311 and the separation rail 211 when the first heat exchanger 200 and the second heat exchanger 300 are closely coupled to each other.

In addition, the plate assembly 100 may further include: an upper plate 120 disposed above the lower plate 110; and a pair of side plates 130 respectively coupled to left and right sides of the lower and upper plates 110 and 120.

In addition, the plate assembly 100 may be completed by coupling the first and second heat exchangers 200 and 300 to the lower plate 110 and then assembling the upper plate 120 and the side plates 130 thereto.

In addition, the separation protrusion 311 may protrude toward the first heat exchanger 200, and have an end bent inclined downward, and the end of the separation protrusion 311 may have an inclination angle corresponding to an inclination angle of the second heat exchanger 300 when the second heat exchanger 300 is slide-coupled to the second slot 112.

In addition, the separation protrusion 311 may have any one shape of a sphere, a square or an ellipse, having a smaller cross-sectional area toward the end.

In addition, the first header tank 210 may include a connection portion 216 formed at each of upper and lower ends of the separation rail 211 and extending to the opposite side of the second heat exchanger 300.

In addition, the first header tank 210 may include a plurality of first reinforcing ribs 213 each formed in front and rear directions of the motor vehicle and spaced apart from each other in the vertical direction, and the first reinforcing rib 213 may connect an end of the second heat exchanger 300 to the separation rail 211.

In addition, the first header tank 210 may include a second reinforcing rib 214 formed in the vertical direction, and the second reinforcing rib 214 may be connected to the plurality of first reinforcing ribs 213 and an end of the connection portion 216.

DETAILED DESCRIPTION OF EMBODIMENTS

Hereinafter, an exemplary embodiment of the present disclosure will be described in detail with reference to the accompanying drawings.

A cooling module 1000 for a motor vehicle according to an exemplary embodiment of the present disclosure only distinguishes a plurality of radiators as a first heat exchanger 200 and a second heat exchanger 300 for convenience. The first and second heat exchangers 200 and 300 may each be a radiator allowing a coolant to flow therethrough and exchanging heat with outside air.

Figure 1:
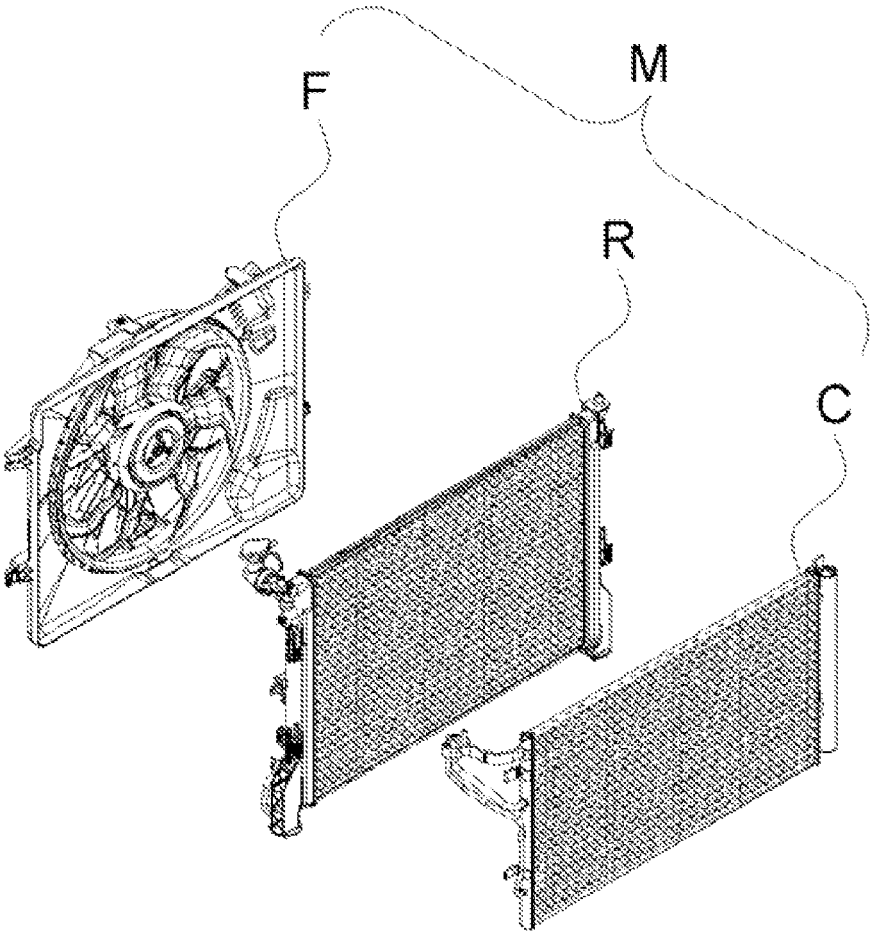
FIG. 1 is an exploded perspective view of a conventional cooling module for a motor vehicle.
Figure 2:
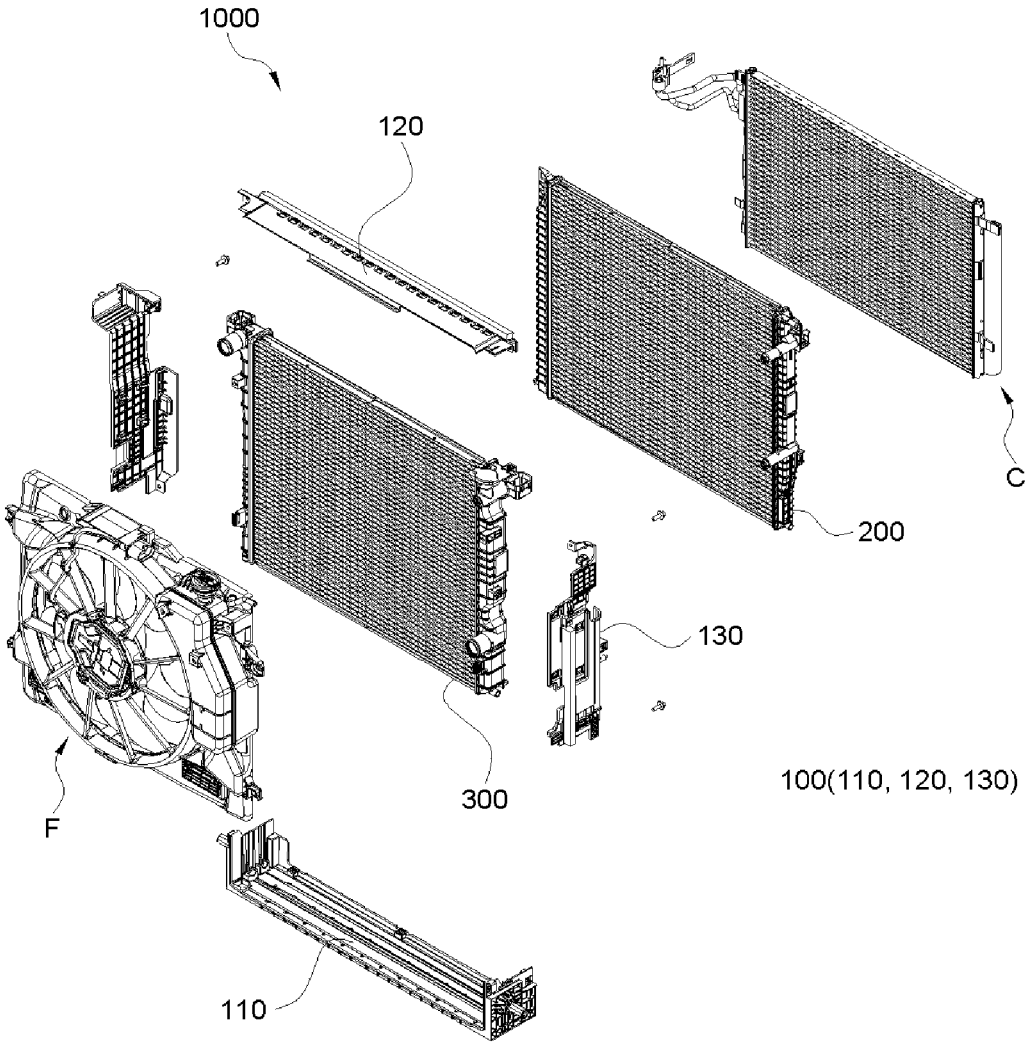
FIG. 2 is an exploded perspective view of a cooling module for a motor vehicle according to an exemplary embodiment of the present disclosure.

FIG. 2 is an exploded perspective view of a cooling module 1000 for a motor vehicle according to an exemplary embodiment of the present disclosure. As shown in the drawing, the cooling module 1000 for a motor vehicle may be basically configured by modularizing: the first heat exchanger 200 through which a first coolant flows to cool an engine; the second heat exchanger 300 through which a second coolant flows to cool an electronic equipment; a condenser C which is disposed in front of the plurality of heat exchangers 200 and 300, and in which a refrigerant flows to condition indoor air; and a fan shroud F disposed at rear of the plurality of heat exchangers 200 and 300, and cooling a radiator R and the condenser C by forced air when the motor vehicle stops its operation. The drawing shows that the first heat exchanger 200 is disposed in front of the second heat exchanger 300, but the second heat exchanger 300 may be disposed in the front of the first heat exchanger 200.

In addition, the cooling module 1000 for a motor vehicle may further include a plate assembly 100 including a plurality of plates 110, 120 and 130 assembled to form a casing surrounding the top, bottom, left and right of the plurality of heat exchangers 200 and 300, and coupled to a front end module FEM.

The present disclosure is not limited to this configuration, and the plate assembly 100 may be a device which is fixed by inserting and receiving some other external devices therein, and then mounted on and fixed to another external structure. That is, when the external devices are the plurality of heat exchangers 200 and 300, and the external structure is the front end module FEM, the plate assembly 100 may be used for the casing of the cooling module, and when the external device and the external structure are other devices or structures, the plate assembly 100 may be used depending on the purpose. Therefore, in the description based on the following embodiments, the plurality of heat exchangers 200 and 300 may be changed to any other external device, and the external structure may be changed to any other external structure.

Figure 3:
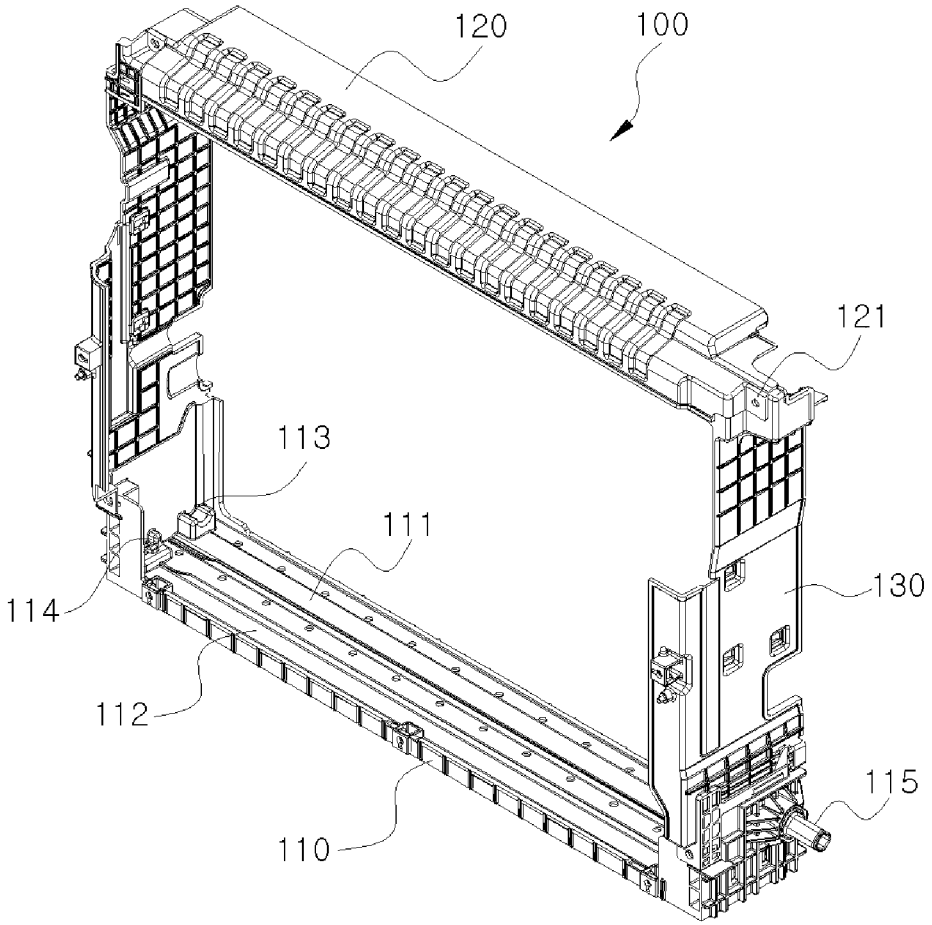
FIG. 3 is a perspective view of a plate assembly according to an exemplary embodiment of the present disclosure.

FIG. 3 is an overall perspective view of a plate assembly 100 according to an exemplary embodiment of the present disclosure. As shown in the drawing, the plate assembly 100 may include: a lower plate 110; an upper plate 120 disposed above the lower plate 110; and a pair of side plates 130 each coupled to respective ends of the lower plate 110 and the upper plate 120 in a width direction of a motor vehicle. The lower plate 110, the upper plate 120 and the side plates 130 may be plates disposed and coupled to the lower, upper and left and right sides of the plurality of heat exchangers 200 and 300, as seen from their names. The plate assembly 100 may be formed by coupling the lower plate 110, the upper plate 120 and the side plates 130 described above to one another to have a square shape such as a square frame and may be made in the form in which the plurality of heat exchangers 200 and 300 are inserted into a central space of the square shape. In addition, the condenser C and the fan shroud F may be inserted into the plate assembly 100, or may be coupled to the end of an open surface of plate assembly 100. That is, the cooling module 1000 for a motor vehicle may be assembled in a shape in which the lower plate 110, the upper plate 120 and the side plates 130 surround each circumference of the plurality of heat exchangers 200 and 300 in the square shape to be fixed to one another and finally form the plate assembly 100. The lower plate 110, the upper plate 120 and the side plates 130 can be bolt-coupled, rivet-coupled or slide-coupled to each other.

In addition, a mounting coupling protrusion 115 may be formed on the lower plate 110 and fitted to a carrier of the front end module FEM, and a coupling hole 121 may be formed in the upper plate 120 and bolt-coupled to the carrier.

In addition, the lower plate 110 may include a first slot 111 to which the first heat exchanger 200 slides downward to be coupled, and a second slot 112 to which the second heat exchanger 300 slides downward to be coupled, which are respectively formed thereon. In addition, the first slot 111 may include a first seating groove 113 formed on each side of the first slot 111 in the width direction, the first seating groove 113 seating a first fixing protrusion 212 thereon, the first fixing protrusion 212 (see FIG. 5) protruding outward from a lower end of a first header tank 210 in the width direction, and the first header tank 210 being formed on each side of the first heat exchanger 200 in the width direction; and the second slot 112 may include a second seating groove 114 formed on each side of the second slot 112 in the width direction, the second seating groove 114 seating a second fixing protrusion 312 thereon, the second fixing protrusion 312 (see FIG. 5) protruding outward from a lower end of a second header tank 310 in the width direction, and the second header tank 310 being formed on each side of the second heat exchanger 300 in the width direction.

Figure 4:
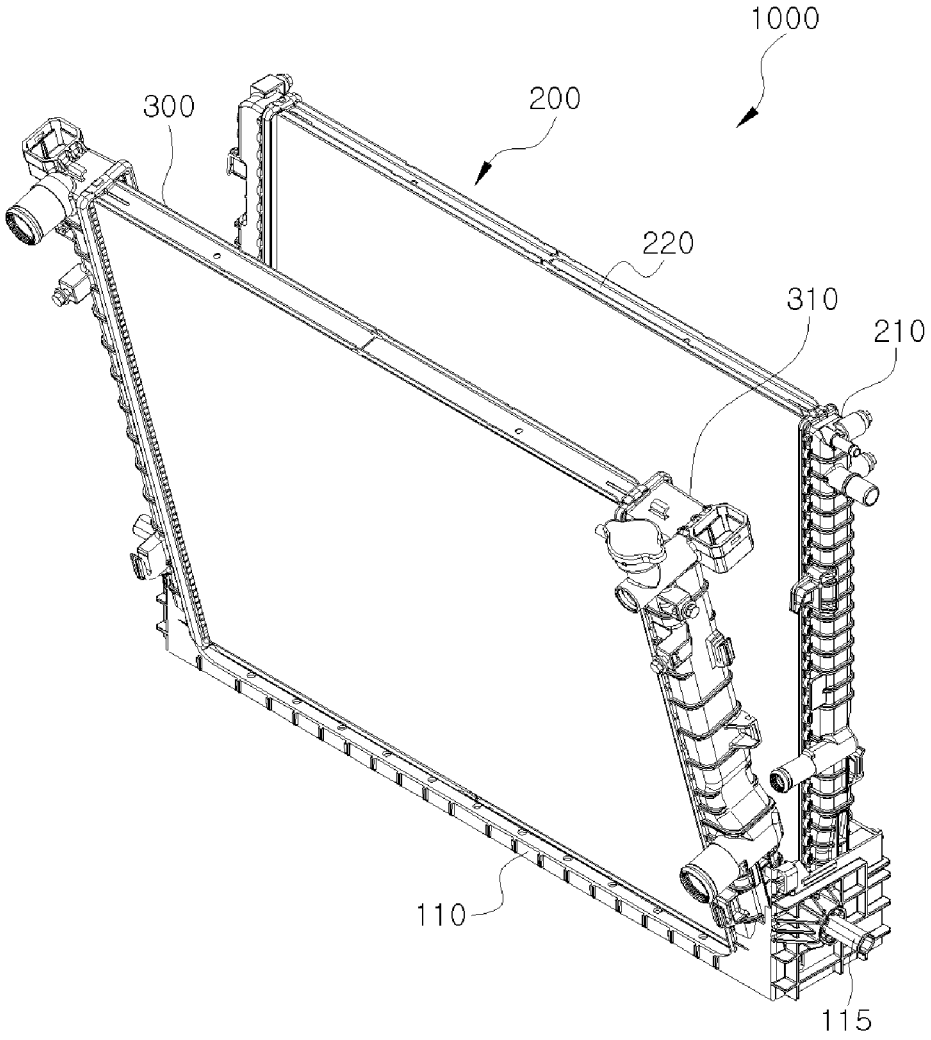
FIG. 4 is a perspective view showing a process in which first and second heat exchangers are coupled to each other on a lower plate of the plate assembly of the present disclosure.

FIG. 4 is a perspective view showing a process in which first and second heat exchangers 200 and 300 are coupled to each other on a lower plate 110 of the plate assembly of the present disclosure.

As shown in the drawing, the first heat exchanger 200 may slide downward into the first slot 111 (see FIG. 3) of the lower plate 110, and the first heat exchanger 200 may slide vertically to be coupled thereto. In addition, when the second heat exchanger 300 slides downward into the second slot 112 (see FIG. 3), and the second heat exchanger 300 slides vertically to be coupled thereto, the first header tank 210 disposed on each side of the first heat exchanger 200 in the width direction of a motor vehicle and the second header tank 310 disposed on each side of the second heat exchanger 300 in the width direction of a motor vehicle may interfere with each other. Therefore, the second heat exchanger 300 may slide downward while having its upper side tilted outward from the first heat exchanger 200 at a predetermined angle in the vertical direction. In a state in which the second heat exchanger 300 completes its downward slide, the upper side of the second heat exchanger 300 may be tilted (pivoted) toward the first heat exchanger 200, thereby allowing the second heat exchanger 300 to complete its coupling with the lower plate 110.

Here, it may be assumed that a distance between a pair of header tanks disposed on both sides of the first heat exchanger 200 in the width direction of a motor vehicle is longer than a distance between a pair of header tanks disposed on both sides of the second heat exchanger 300 in the width direction of a motor vehicle. In this case, during the assembling process, the second header tank 310 disposed on both the sides of the second heat exchanger 300 in the width direction of a motor vehicle may interfere with and impact a core portion 220 of the first heat exchanger 200. Accordingly, the core portion 220 may be damaged or broken. Therefore, the cooling module 1000 for a motor vehicle according to an exemplary embodiment of the present disclosure has the following characteristic configuration to prevent such damage or breakage of the core portion 220. Hereinafter, the characteristic configuration is described in detail with reference to the drawings.

Figure 5:
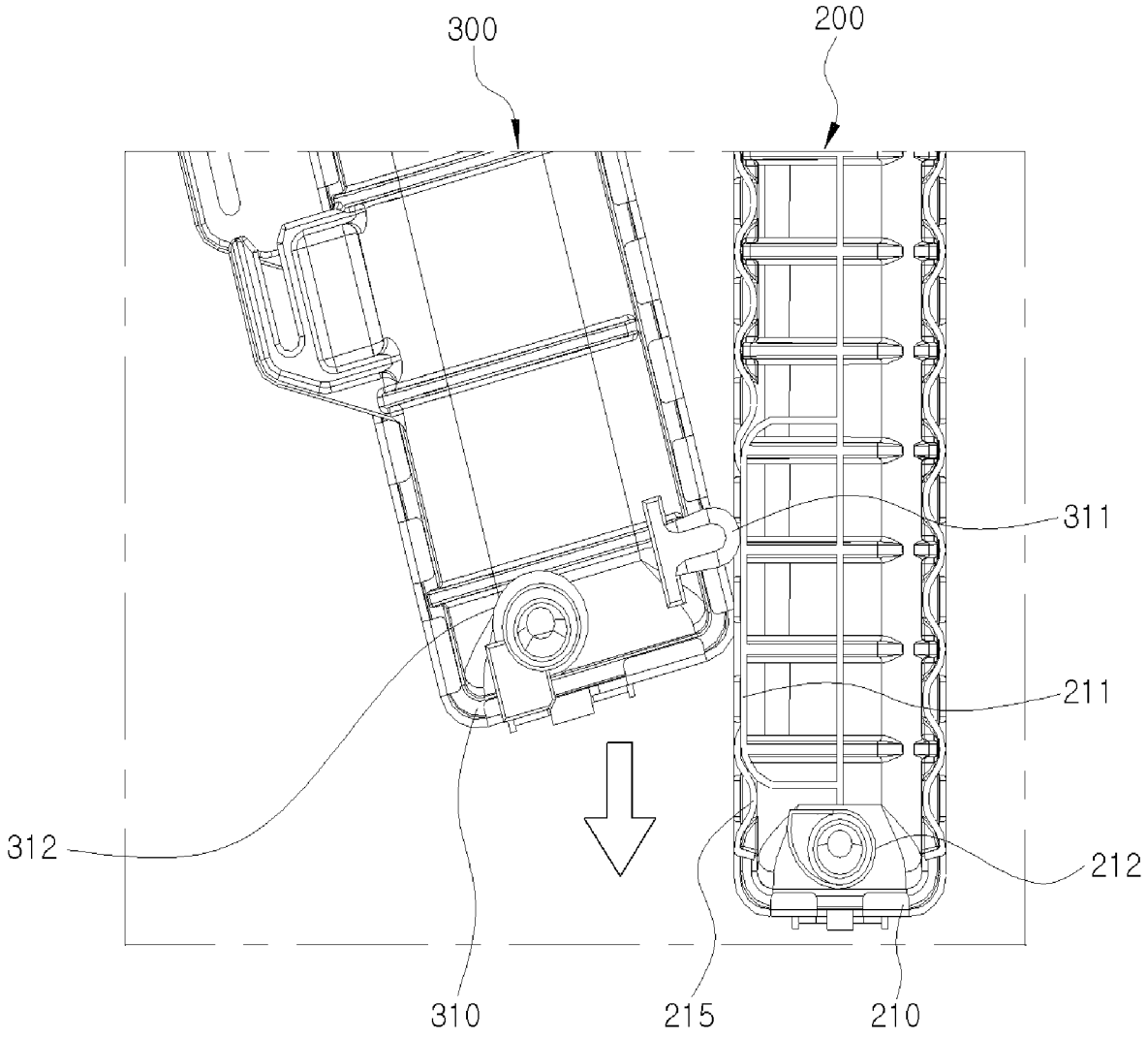
FIG. 5 is a side view showing a process in which the first and second heat exchangers are coupled to each other on the lower plate of the cooling module for a motor vehicle of the present disclosure.
Figure 6:
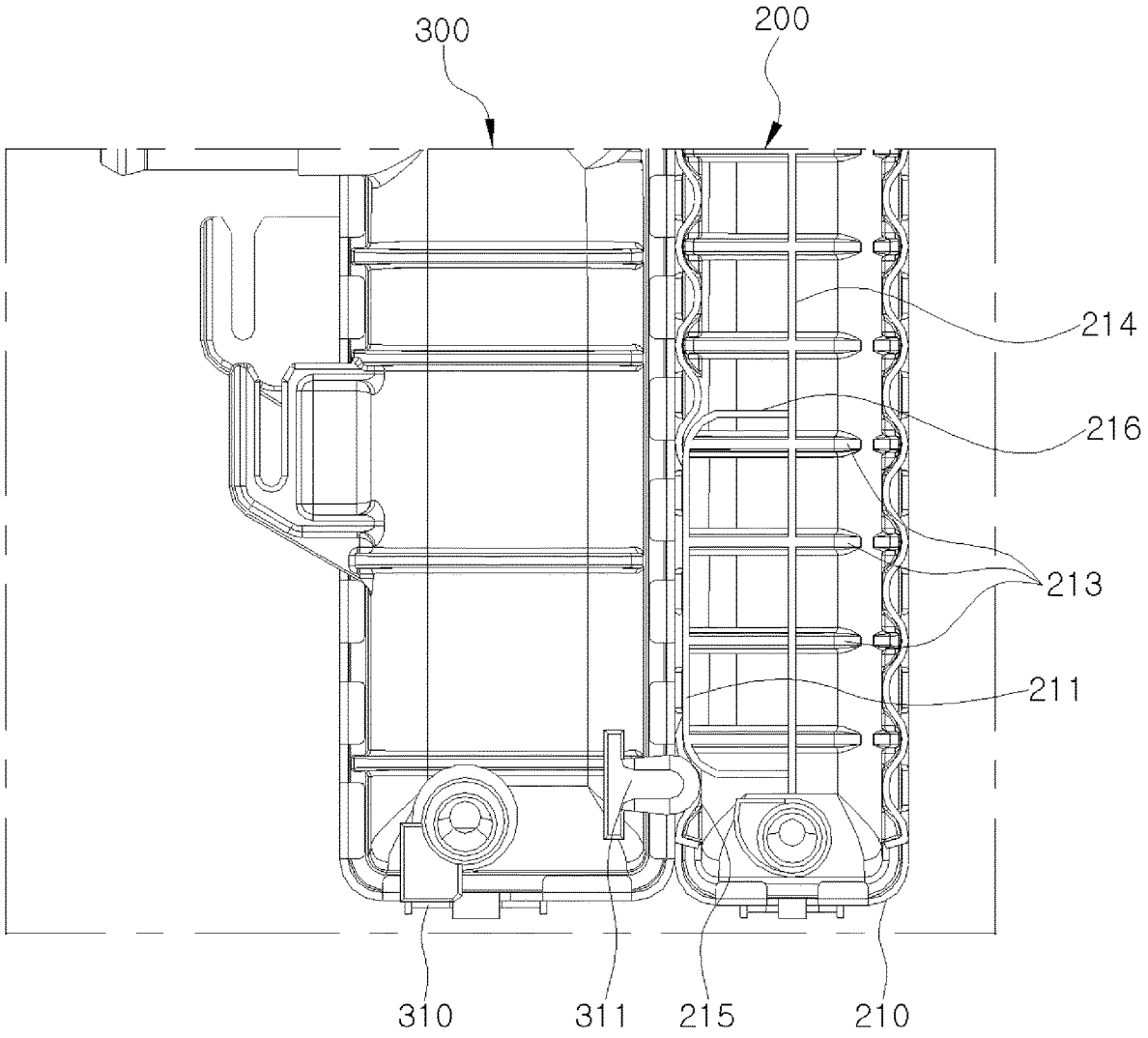
FIG. 6 is a side view of the first and second heat exchangers already coupled to each other on the lower plate of the cooling module for a motor vehicle of the present disclosure.

FIG. 5 is a side view showing a process in which the first and second heat exchangers 200 and 300 are coupled to each other on the lower plate 110 of the cooling module 1000 for a motor vehicle according to an exemplary embodiment of the present disclosure; and FIG. 6 is a side view of the first and second heat exchangers 200 and 300 already coupled to each other on the lower plate 110 of the cooling module 1000 for a motor vehicle according to an exemplary embodiment of the present disclosure.

As shown in the drawing, in a state in which the first heat exchanger 200 is fixedly coupled to the lower plate 110 (see FIGS. 3 and 4), the second heat exchanger 300 may be coupled downward to the lower plate while having its upper side tilted at an angle to the rear side of the motor vehicle in the vertical direction. Here, a separation protrusion 311 may be formed on the second header tank 310 of the second heat exchanger 300 for the second header tank 310 of the second heat exchanger 300 to maintain separation from the core portion 220 (see FIG. 4) of the first heat exchanger 200, and a separation rail 211 corresponding to the separation protrusion 311 may be formed on the first header tank 210 of the first heat exchanger 200.

The separation protrusion 311 may have a predetermined thickness from the lower end of the second header tank 310 outward in the width direction, and protrude toward the first heat exchanger 200. Here, it is preferable that the separation protrusion 311 is thick enough to come in contact with the separation rail 211 formed on the first header tank 210 when assembling the second heat exchanger 300 in consideration of the difference between the distance between the pair of header tanks of the first heat exchanger 200 and the distance between the pair of header tanks of the second heat exchanger 300.

In addition, the separation rail 211 may have a predetermined thickness from the lower end of the first header tank 210 outward in the width direction and protrude toward the second heat exchanger 300, and may be formed in the vertical direction so that an end of the separation protrusion 311 comes in contact with the separation rail 211 and slides downward when the second heat exchanger 300 slides downward to be coupled to the lower plate 110.

Therefore, when the second heat exchanger 300 slides downward to be coupled to the lower plate 110, the separation protrusion 311 may come in contact with the separation rail 211 and slide downward. Accordingly, the separation rail 211 may guide the second header tank 310 of the second heat exchanger 300 not to impact the core portion 220 of the first heat exchanger 200, and to be coupled to the lower plate 110 while maintaining the separation from the core portion 220. To this end, the separation rail 211 may be formed to further protrude toward the first heat exchanger 200 than ends of the core portion 220 of the first heat exchanger 200 in front and rear directions of a motor vehicle.

Meanwhile, as the second heat exchanger 300 slides downward, the second fixing protrusion 312 of the second heat exchanger 300 may be seated in the second seating groove 114 (see FIG. 3) of the lower plate 110. In this state, the second heat exchanger 300 may be pivoted using the second fixing protrusion 312 as its rotating shaft to be closely coupled to the first heat exchanger 200. Here, a rail groove 215 may be formed on the separation rail 211 which comes in contact with the separation protrusion 311 to prevent interference by the separation protrusion 311 when the first heat exchanger 200 and the second heat exchanger 300 are closely coupled to each other. The rail groove 215 can be formed to be recessed to the opposite side of the second heat exchanger 300.

In addition, a connection portion 216 may be formed on the first header tank 210, i.e., formed at each of upper and lower ends of the separation rail 211, may extend to the opposite side of the second heat exchanger 300, and may protrude outward in the width direction of the first header tank 210. In addition, a plurality of first reinforcing ribs 213 may each be formed on the first header tank 210 in the front and rear directions of a motor vehicle, and may be spaced apart from each other in the vertical direction. The first reinforcing rib 213 may also protrude outward in the width direction of the first header tank 210, and may connect an end of the second heat exchanger 300 to the separation rail 211.

In addition, a second reinforcing rib 214 may be formed on the first header tank 210 in the vertical direction and may protrude outward in the width direction of the first header tank 210. The second reinforcing rib 214 may be connected to the plurality of first reinforcing ribs 213 and an end of the connection portion 216.

Figure 7:
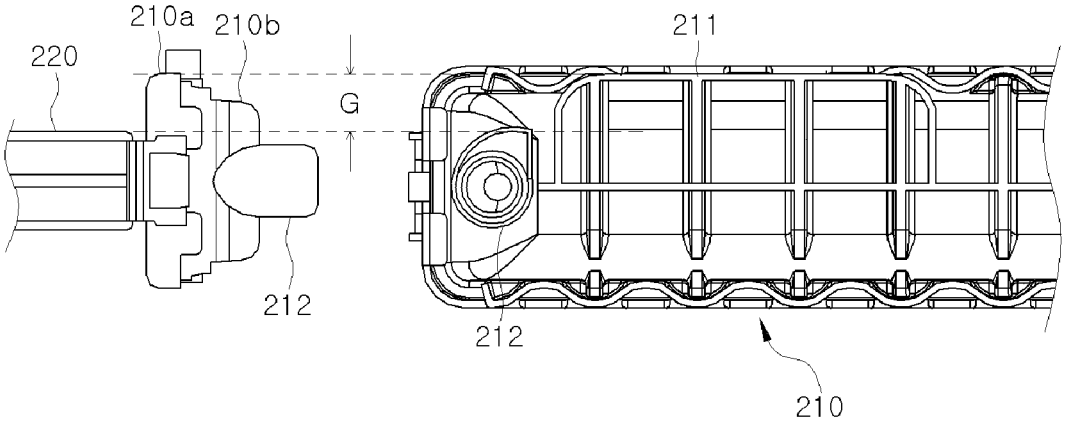
FIG. 7 shows a partial plan view (left) and a partial side view (right) of the first heat exchanger according to an exemplary embodiment of the present disclosure.

FIG. 7 shows a partial plan view and a partial side view of the first heat exchanger 200 according to an exemplary embodiment of the present disclosure.

As shown in the drawing, the separation rail 211 formed on the first header tank 210 of the first heat exchanger 200 of the present disclosure may have an end protruding further toward the second heat exchanger 300 than an end of the core portion 220 of the first heat exchanger 200 on a basis of the second heat exchanger 300 (protruding by "G" in the drawing).

Therefore, the separation protrusion 311 of the second heat exchanger 300 may come in contact with the separation rail 211 of the first heat exchanger 200 before the second header tank 310 comes in contact with the core portion 220 of the first heat exchanger 200 when the second heat exchanger 300 is coupled to the lower plate 110. Accordingly, the second header tank 310 of the second heat exchanger 300 and the core portion 220 of the first heat exchanger 200 may always maintain the separation from each other.

For another example, a point at which the separation rail 211 of the first heat exchanger 200 and the separation protrusion 311 of the second heat exchanger 300 come in contact with each other may be disposed to be spaced apart from the end of the core portion 220 toward the second heat exchanger 300. Also in the above embodiment, the second header tank 310 of the second heat exchanger 300 and the core portion 220 of the first heat exchanger 200 may maintain the separation from each other when the separation protrusion 311 of the second heat exchanger 300 comes in contact with the separation rail 211 for the second heat exchanger 300 to be coupled to the lower plate 110.

FIG. 8A to 8D are side views each showing a separation protrusion 311 according to various embodiments of the present disclosure. As shown in the drawings, the separation protrusion 311 can have various shapes based on a separation distance between the first heat exchanger 200 and the second heat exchanger 300 or a shape of the header tank.

Figure 8A:
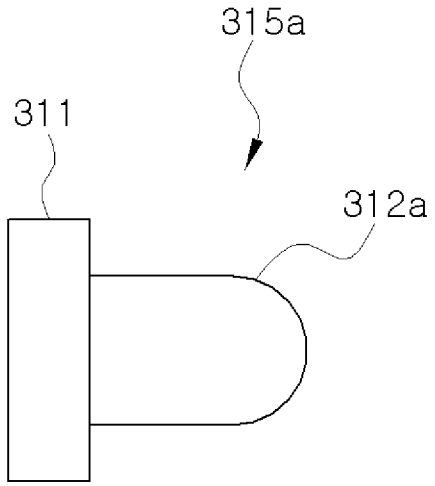
FIG. 8A to 8D are side views each showing various embodiments of a protrusion of the present disclosure that prevents damage to a core portion.

As shown in FIG. 8A, the separation protrusion 311 according to a first embodiment may include a circular protrusion 312*a* having a circular edge.

Figure 8B:
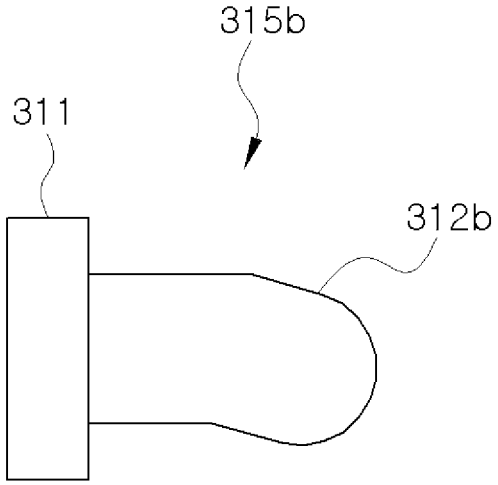

In addition, as shown in FIG. 8B, the separation protrusion 311 according to a second embodiment may include a bent circular protrusion 312*b* having a circular edge and an end bent inclined downward. In this case, the end of the separation protrusion 311 may have an inclination angle corresponding to an inclination angle of the second heat exchanger 300 when the second heat exchanger 300 is slide-coupled to the second slot 112. Therefore, even when the second heat exchanger 300 is tilted and coupled to the first heat exchanger 200, the end of the separation protrusion 311 can be in vertical contact with the separation rail 211.

Figure 8C:
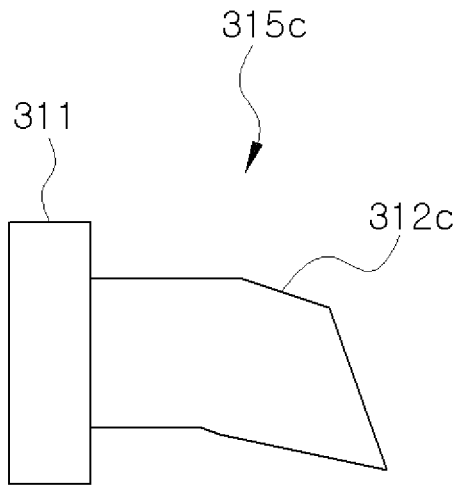
Figure 8D:
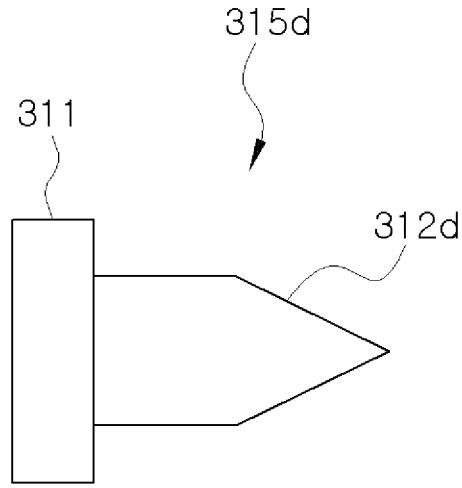

In addition, as shown in FIG. 8C, the separation protrusion 311 according to a third embodiment may include an angular protrusion 312*c* having an angular corner, and, as shown in FIG. 8D, the separation protrusion 311 according to a fourth embodiment may include a bent prismatic protrusion 312*d* having an angular corner and an end bent obliquely downward.

As set forth above, in the cooling module for a motor vehicle of the present disclosure having the above configuration, the plurality of radiators may be slide-fitted into the plate assembly, thereby requiring fewer assembly processes.

In addition, when the plurality of radiators are coupled to the plate assembly, the core portion of another radiator may be prevented from being damaged due to the header tank of one radiator. Therefore, it is possible to reduce a defect rate during producing a product and save cost and time taken to repair a damaged core portion.

In addition, the core damage prevention structure is simple, and may thus be applied to a process of producing the existing cooling module, at low cost.

In addition, the slide-coupling structure of the plate assembly may guide the assembly of the plurality of radiators. Accordingly, it is possible to easily guide the precise assembly of the plurality of radiators, thereby having the improved assembly precision.

The present disclosure is not to be construed as being limited to the above-mentioned exemplary embodiment. The present disclosure may be applied to various fields and may be variously modified by those skilled in the art without departing from the scope of the present disclosure claimed in the claims. Therefore, it is obvious to those skilled in the art that these alterations and modifications fall in the scope of the present disclosure.

What is claimed is:

1. A cooling module for a motor vehicle, including heat exchangers and a fan shroud, the cooling module for a motor vehicle comprising:

a plurality of heat exchangers;

a plate assembly including a lower plate to which lower ends of the plurality of heat exchangers are respectively coupled; and separation means preventing a core portion of a first heat exchanger from being damaged when mounting a second heat exchanger on the lower plate, the lower plate having the first heat exchanger mounted thereon.

2. The cooling module for a motor vehicle of claim 1, wherein the first heat exchanger includes a first header tank formed on each side thereof in a width direction of a motor vehicle, and the core portion formed between the pair of first header tanks, and the separation means prevent the core portion and the second header tank which is formed on each side of the second heat exchanger in the width direction of the motor vehicle from being in contact with each other when the second heat exchanger is coupled to the lower plate.

3. The cooling module for a motor vehicle of claim 2, wherein the lower plate includes:

a first slot to which the first heat exchanger slides downward to be coupled, and a second slot to which the second heat exchanger slides downward to be coupled and which is formed in front of or behind the first slot in front and rear directions of the motor vehicle.

4. The cooling module for a motor vehicle of claim 3, wherein the first slot includes a first seating groove formed on each side of the first slot in the width direction, the first seating groove seating a first fixing protrusion thereon, and the first fixing protrusion protruding outward from a lower end of the first header tank in the width direction, and the second slot includes a second seating groove formed on each side of the second slot in the width direction, the second seating groove seating a second fixing protrusion thereon, and the second fixing protrusion protruding outward from a lower end of the second header tank in the width direction.

5. The cooling module for a motor vehicle of claim 4, wherein the first heat exchanger slides vertically to be coupled to the first slot, and the second heat exchanger is slide-coupled to the second slot in a state in which the second heat exchanger is tilted outward from the first heat exchanger to have an upper side further spaced apart from the first heat exchanger, and the second heat exchanger completes its coupling with the lower plate by tilting the upper side of the second heat exchanger toward the first heat exchanger in a state in which the second heat exchanger completes its slide.

6. The cooling module for a motor vehicle of claim 5, wherein as the second heat exchanger slides downward, the second fixing protrusion is seated in the second seating groove, and the second heat exchanger is then pivoted using the second fixing protrusion as its rotating shaft to be closely coupled to the first heat exchanger.

7. The cooling module for a motor vehicle of claim 5, wherein the separation protrusion protrudes toward the first heat exchanger, and has an end bent inclined downward, and the end of the separation protrusion has an inclination angle corresponding to an inclination angle of the second heat exchanger when the second heat exchanger is slide-coupled to the second slot.

8. The cooling module for a motor vehicle of claim 1, wherein the plate assembly further includes:

an upper plate disposed above the lower plate; and a pair of side plates respectively coupled to left and right sides of the lower and upper plates.

9. The cooling module for a motor vehicle of claim 8, wherein the plate assembly is completed by coupling the first and second heat exchangers to the lower plate and then assembling the upper plate and the side plates thereto.

10. A cooling module for a motor vehicle, including heat exchangers and a fan shroud, the cooling module for a motor vehicle comprising:

a plurality of heat exchangers;

a plate assembly including a lower plate to which lower ends of the plurality of heat exchangers are respectively coupled; and separation means preventing a core portion of a first heat exchanger from being damaged when mounting a second heat exchanger on the lower plate, the lower plate having the first heat exchanger mounted thereon, wherein the separation means include:

a separation protrusion protruding from the second header tank toward the first heat exchanger; and a separation rail formed on the first header tank, protruding toward the second heat exchanger to come in contact with an end of the separation protrusion when the second heat exchanger is coupled to the lower plate, and formed in the vertical direction, wherein the separation rail has an end protruding further toward the second heat exchanger than an end of the core portion on a basis of the second heat exchanger.

11. The cooling module for a motor vehicle of claim 10, wherein a rail groove is formed on a lower end of the separation rail, which comes in contact with the separation protrusion, to prevent interferences by the separation protrusion and the separation rail when the first heat exchanger and the second heat exchanger are coupled to each other, the rail groove being formed to be recessed to the opposite side of the second heat exchanger.

12. The cooling module for a motor vehicle of claim 10, wherein the separation protrusion has any one shape of a sphere, a square or an ellipse, having a smaller cross-sectional area toward the end.

13. The cooling module for a motor vehicle of claim 10, wherein the first header tank includes a connection portion formed at each of upper and lower ends of the separation rail and extending to the opposite side of the second heat exchanger.

14. The cooling module for a motor vehicle of claim 13, wherein the first header tank includes a plurality of first reinforcing ribs each formed in front and rear directions of the motor vehicle and spaced apart from each other in the vertical direction, and the first reinforcing rib connects an end of the second heat exchanger to the separation rail.

15. The cooling module for a motor vehicle of claim 14, wherein the first header tank includes a second reinforcing rib formed in the vertical direction, and the second reinforcing rib is connected to the plurality of first reinforcing ribs and an end of the connection portion.

16. A cooling module for a motor vehicle, including heat exchangers and a fan shroud, the cooling module for a motor vehicle comprising:

a plurality of heat exchangers;

a plate assembly including a lower plate to which lower ends of the plurality of heat exchangers are respectively coupled; and separation means preventing a core portion of a first heat exchanger from being damaged when mounting a second heat exchanger on the lower plate mounted the first heat exchanger, wherein a point at which the separation rail and the separation protrusion come into contact with each other when the second heat exchanger is coupled to the lower plate is disposed to be spaced apart from the end of the core portion toward the second heat exchanger.

* * * * *